United States Patent [19]

Lucius

[11] 4,385,794

[45] May 31, 1983

[54] INSULATION DISPLACEMENT TERMINAL

[75] Inventor: John E. Lucius, Harrisburg, Pa.

[73] Assignee: AMP Incorporated, Harrisburg, Pa.

[21] Appl. No.: 351,725

[22] Filed: Feb. 24, 1982

Related U.S. Application Data

[63] Continuation of Ser. No. 927,720, Jul. 25, 1978, abandoned.

[51] Int. Cl.[3] ..... H01R 13/38

[52] U.S. Cl. ..... 339/97 R; 339/276 SF

[58] Field of Search ..... 339/97 R, 97 P, 98, 339/99 R, 276 SF

[56] References Cited

U.S. PATENT DOCUMENTS

| | | | |
|---|---|---|---|
| 2,748,452 | 6/1956 | Pierce | 339/276 SF |
| 3,162,501 | 12/1964 | Wahl | 339/98 |
| 3,383,640 | 5/1968 | Godziemba | 339/95 D |
| 3,760,331 | 9/1973 | Gurley | 339/97 P |
| 3,959,868 | 6/1976 | Mathe | 339/97 P |
| 4,018,177 | 4/1977 | McKee | 339/97 R |
| 4,027,521 | 6/1977 | McKee | 72/404 |
| 4,032,215 | 6/1977 | Jarmofsky | 339/258 R |
| 4,035,049 | 7/1977 | McKee | 339/97 R |
| 4,040,702 | 8/1977 | McKee | 339/97 R |
| 4,050,760 | 9/1977 | McKee | 339/97 R |
| 4,153,324 | 5/1979 | Kukla | 339/97 R |
| 4,208,083 | 6/1980 | Kirby | 339/97 P |

FOREIGN PATENT DOCUMENTS

| | | | |
|---|---|---|---|
| 2856549 | 7/1979 | Fed. Rep. of Germany | 339/97 R |
| 2004425 | 3/1979 | United Kingdom | 339/97 R |

*Primary Examiner*—Joseph H. McGlynn
*Attorney, Agent, or Firm*—Russell J. Egan

[57] ABSTRACT

An electrical terminal is disclosed for use in the insulation displacing termination of conductors having substantially any center spacing. The terminal is provided with two spaced apart and substantially parallel side beam members which define a conductor receiving channel therebetween. Each side beam has at least one insulation piercing extension perpendicularly formed therefrom to extend into the channel toward a corresponding extension formed from the opposite side beam. As the conductor is moved laterally of its axis and into the channel, the edges of the corresponding insulation piercing extensions serve to pierce the insulative covering of the conductor and establish electrical and mechanical contact between the terminal and the conductor. Termination tooling for use in terminating the conductor is also disclosed and includes a pressing bar, and a block having supportive means for reinforcing the terminal side beams during the termination procedure.

10 Claims, 8 Drawing Figures

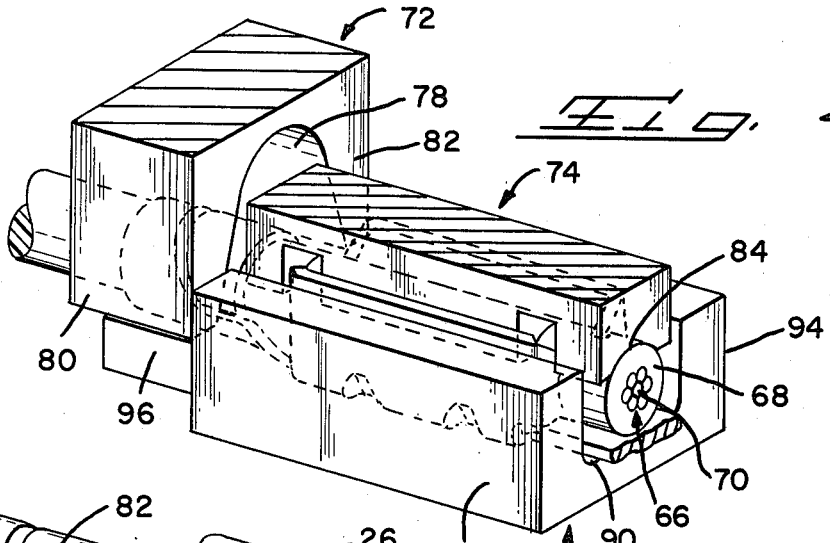
Fig. 4
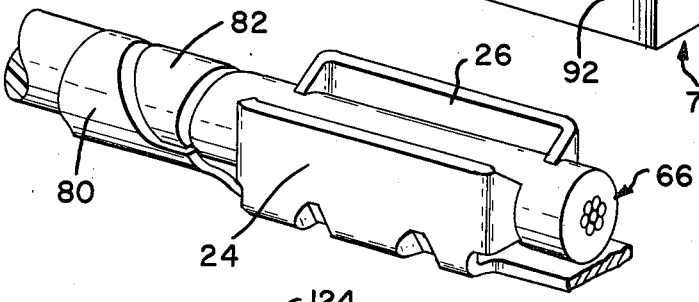
Fig. 5
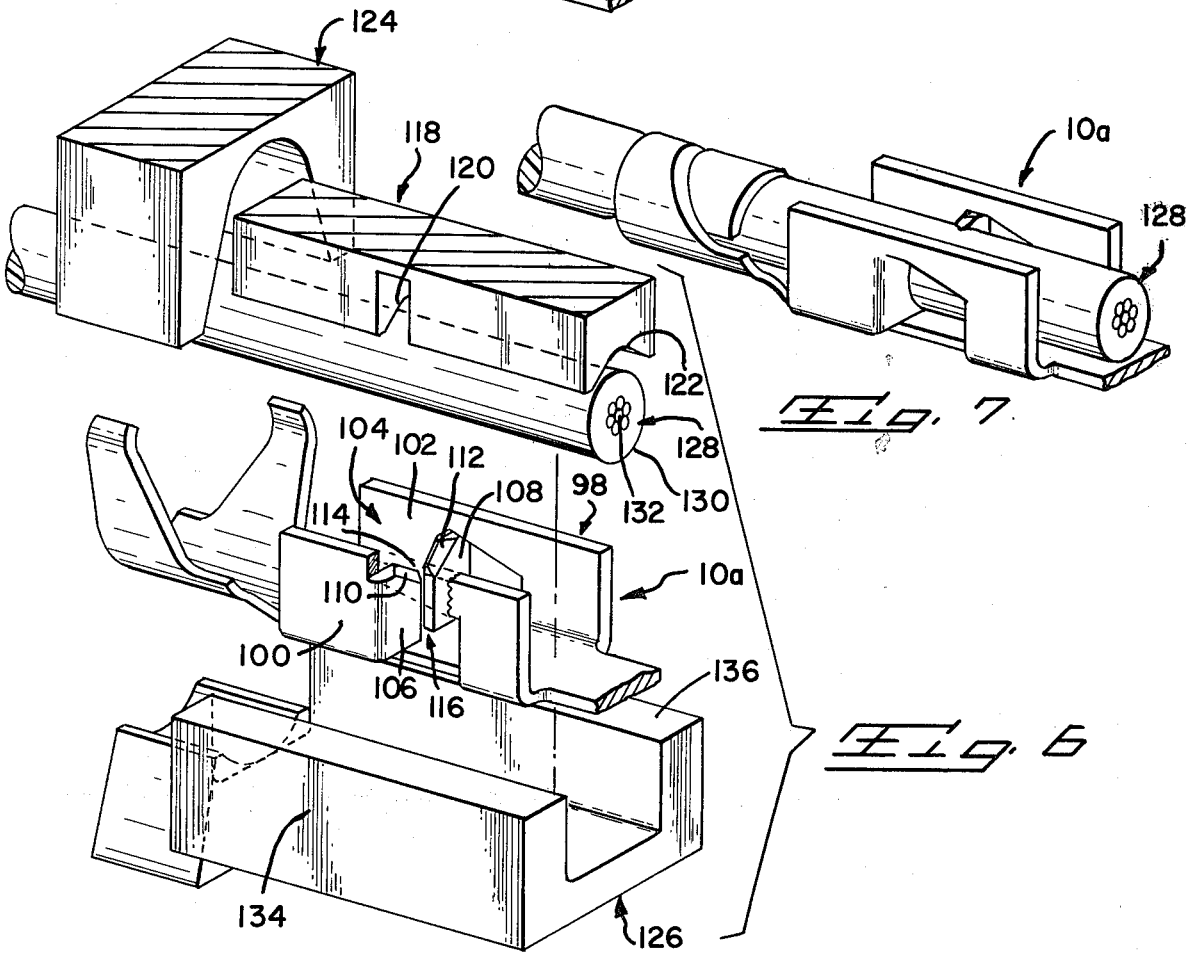
Fig. 7
Fig. 6

INSULATION DISPLACEMENT TERMINAL

This is a continuation, of application Ser. No. 927,720, filed July 25, 1978, now abandoned.

BACKGROUND OF THE INVENTION

1. The Field Of The Invention

This invention relates to electrical terminals used in insulation piercing termination of conductors having substantially any center spacing.

2. Description Of The Prior Art

A trend within the electrical industry in recent years has been toward the miniaturization of electrical devices and, in particular, the reduction in size of the interconnection systems associated with such devices. Correspondingly, the need has arisen for an inexpensively produced, space efficient, insulation displacing terminal for terminating insulated conductors on closely spaced centers.

The difficulty in terminating conductors on close centers, coupled with the desirability of effecting such a termination by an insulation displacing technique, has represented a dilemma to those within the electrical industry attempting to invent a suitable terminal. To terminate wires on close centers, the maximum width dimension of a terminal is limited by the spacing between adjacent conductors. Insulation displacing termination, however, mandates that the terminal's slot defining portion which receives the conductor be of sufficient thickness to achieve a minimum level of rigidity. This rigidity is necessary to enable the terminal to effectively pierce through the insulative sleeve of the inserted conductor and establish electrical and mechanical contact therewith. Moreover, the terminal's influence on the wire in the post termination state is optimally expected to be of a resilient nature in order to preserve the electrical and mechanical integrity of the connection under a myriad of constantly changing environmental influences. In addition to the above constraints, the terminal must be easily produced for economic reasons, and must require a minimal amount of insertion force to facilitate the termination of a conductor.

Heretofore, no electrical terminal had been invented which could satisfy the cost, performance, and space constraints outlined above. U.S. Pat. No. 3,162,501 discloses a terminal adapted to displace insulation and terminate conductors which are not on relatively close center lines. While this terminal has been well received by the industry and works well in some applications, the terminal is relatively complex in structure and is not suited for applications where conductors having relatively tough insulative coverings are to be terminated.

U.S. Pat. No. 4,018,177 discloses a terminal for effecting insulation displacing termination of conductors on close centers, but while this terminal works well in certain applications, it is relatively more complicated to form and is not suited for applications where a highly resilient residual force must be maintained on a terminated conductor; or where the insulative covering on the conductor is relatively tough and therefore difficult to penetrate.

SUMMARY OF THE INVENTION

The subject electrical terminal is intended for use in making an insulation piercing termination of discrete conductors having substantially any center spacing.

The terminal is provided with two parallel side beams which are spaced apart to define a conductor receiving channel therebetween; the channel being dimensioned to closely receive an insulated conductor longitudinally therein. An insulation piercing extension is formed from each side beam, perpendicular thereto, and extends inwardly into the conductor receiving channel. Each insulation piercing extension presents an exposed edge to the conductor receiving channel, with the exposed edge of one piercing extension being spaced from the exposed edge of a corresponding insulation piercing extension to form a slot. The corresponding edge portions are advantageously spaced apart, and are adapted to pierce the insulation to mechanically and electrically engage a conductor which is moved laterally of its axis between the side beams and into the conductor receiving channel. Because the channel is dimensioned only slightly larger than the diameter of a conductor, the terminal can be made narrow enough to comply with the space constraints imposed by conductors on close center lines. Termination tooling for the subject terminal functions partially to support the terminal side beams against outward deflection during the termination procedure, and the structure of the terminal is such that a residual spring-like force is maintained on the terminated wire to ensure and preserve positive electrical contact in a changing environment.

It is accordingly an object of the instant invention to provide an insulation displacement terminal which can terminate conductors on closely spaced center lines.

A further object is to provide an insulation displacing terminal which can terminate discrete conductors having substantially any center spacing.

A further object of the instant invention is to provide a terminal which can resiliently maintain good electrical and mechanical contact with a terminated conductor in a dynamic environment.

Another object of the instant invention is to provide a terminal which can, with a minimal insertion force, effect insulation displacing contact with a conductor.

Yet another object of the instant invention is to provide an electrical terminal which can effect insulation displacing contact with a conductor having a relatively tough insulative covering.

Yet another object of the instant invention is to provide a terminal which can be readily and economically manufactured.

These and other objects which will be apparent to one skilled in the art are achieved in a preferred embodiment of the instant invention which is described in detail below and illustrated in the accompanying drawings.

BRIEF DESCRIPTION OF THE DRAWINGS

FIG. 4 is a perspective view of the terminal, the conductor, and the termination tooling at the end of the termination stroke;

FIG. 5 is a perspective view of the terminal and the terminated conductor;

FIG. 6 is an exploded perspective view of an alternative embodiment of the instant invention with corresponding termination tooling; and FIG. 7 is a perspective view of the alternate embodiment of the subject terminal and a terminated conductor.

DETAILED DESCRIPTION OF THE PREFERRED EMBODIMENT

Figure 1:
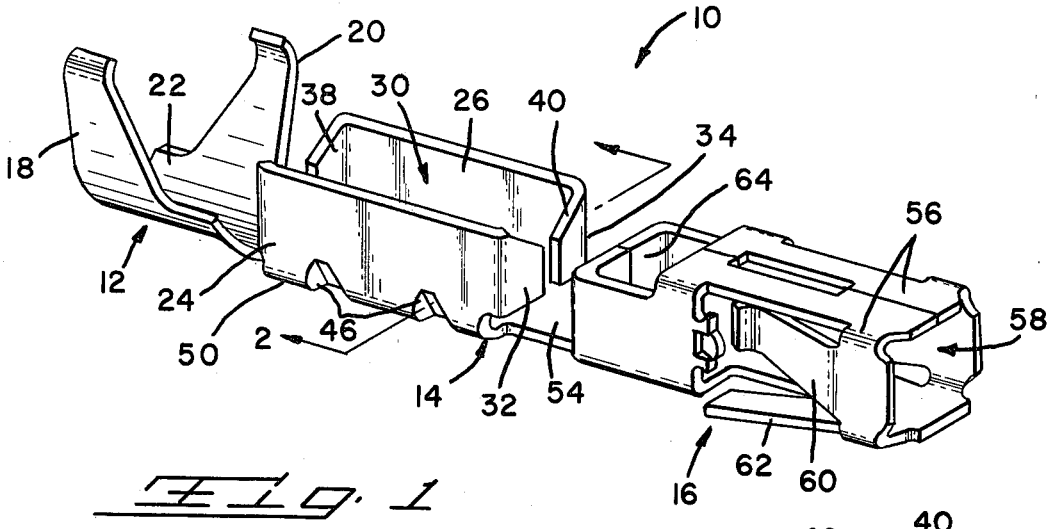
FIG. 1 is a perspective view of a preferred embodiment of the subject terminal.

Referring first to FIG. 1, the subject terminal 10 is shown to comprise a rearward insulation supporting portion 12, an intermediate conductor engaging portion 14, and a forward portion 16 illustratively shown to be a pin receptacle of the type shown in U.S. Pat. No. 3,363,224. While forward portion 16 is representatively shown to be a pin socket, other contact configurations such as a male pin member could be used, and such other configurations are intended to be within the purview of the subject invention. The rearward portion 12 structurally includes a pair of arms 18, 20 which are counter and offset with respect to each other, and which project upwardly from a webbed base 22. The arms 18, 20 are formed of malleable metal and are generally arcuate in profile.

Figure 2:
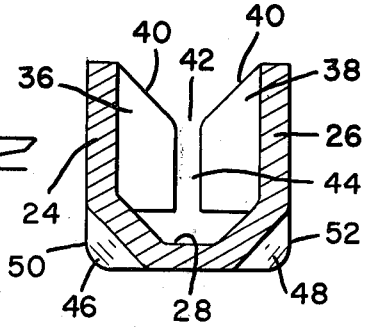
FIG. 2 is a cross sectional view of the terminal taken along line 2—2 of FIG. 1.

The intermediate conductor engaging portion 14 comprises a pair of spaced apart, parallel side beams 24, 26 extending upwardly from a terminal floor 28, as shown in FIGS. 1 and 2. The side beams 24, 26 define a conductor receiving channel 30 therebetween, and each side beam further includes a forward gate portion 32, 34 and a rearward gate portion 36, 38 respectively. Each gate portion is formed at substantially a right angle to its respective side beam to project inwardly into the conductor receiving channel 30 toward an opposite gate portion.

As shown in FIGS. 1 and 2, each of the gate portions presents an exposed edge 40 to the conductor receiving channel 30, with corresponding and opposite exposed edges defining a funnel shaped upper entry portion 42 leading to a lower insulation piercing slot 44, with each of the slots 44 having a substantially constant width toward the terminal floor 28.

With continuing reference to FIGS. 1 and 2, the intermediate conductor engaging portion 14 is further provided with indents 46, 48 formed in respective side beams 24, 26 along lower longitudinal bends 50, 52 respectively. The indents 46, 48 extend inwardly into the conductor receiving channel 30 and serve to increase the rigidity of their respective side beams and prevent buckling and bending type deformation. While representatively shown as being located along bends 50, 52, it should be noted that the indents could be located elsewhere in a respective beam and still contribute to increasing the rigidity of that side beam.

The intermediate conductor engaging portion 14 is integral with the forward receptacle portion 16 through a connective strip 54 of the terminal 10. As shown in FIG. 1, the forward receptacle portion 16 is of a generally box-like configuration having four sides 56 which define a pin receiving cavity 58. An inwardly biased pin retaining arm 60 is formed to extend inwardly into the cavity 58, and serves to engageably retain a pin (not shown). Further provided in receptacle 16 is an outwardly extending latching tine 62 adapted to retain the terminal 10 in a suitable connector housing (not shown), and a barrier wall 64 to prevent the over insertion of a pin. A pin receptacle of this type is disclosed in U.S. Pat. No. 3,363,224 which is hereby incorporated by reference.

Figure 2A:
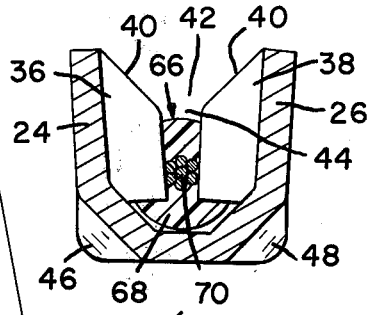
FIG. 2A is a cross sectional view of the subject terminal, similar to FIG. 2, showing a terminated conductor in the terminal.

Referring now to FIGS. 2, and 2A, the conductor engaging portion 14 of the terminal 10 is intended for use in terminating a conductor 66 having an outer insulative covering 68, and an inner conductive portion 70. While the subject terminal finds particular application in terminating a plurality of conductors on close center lines, it is contemplated that the terminal also has application in terminating discrete conductors, and terminating conductors on relatively spaced apart centers. The inner conductive portion 70 of conductor 66 is representatively shown to be a plurality of discrete wires, but it should be appreciated that the principles of the subject invention also find application where the inner conductive portion is a solid wire. Comparatively viewing FIGS. 2 and 2A, the normal spacing between side beams 24, 26 is slightly greater than the outer diameter of conductor 66, and the width of the conductor piercing slot 44 is slightly less than the diameter of inner conductive portion 70.

Figure 3:
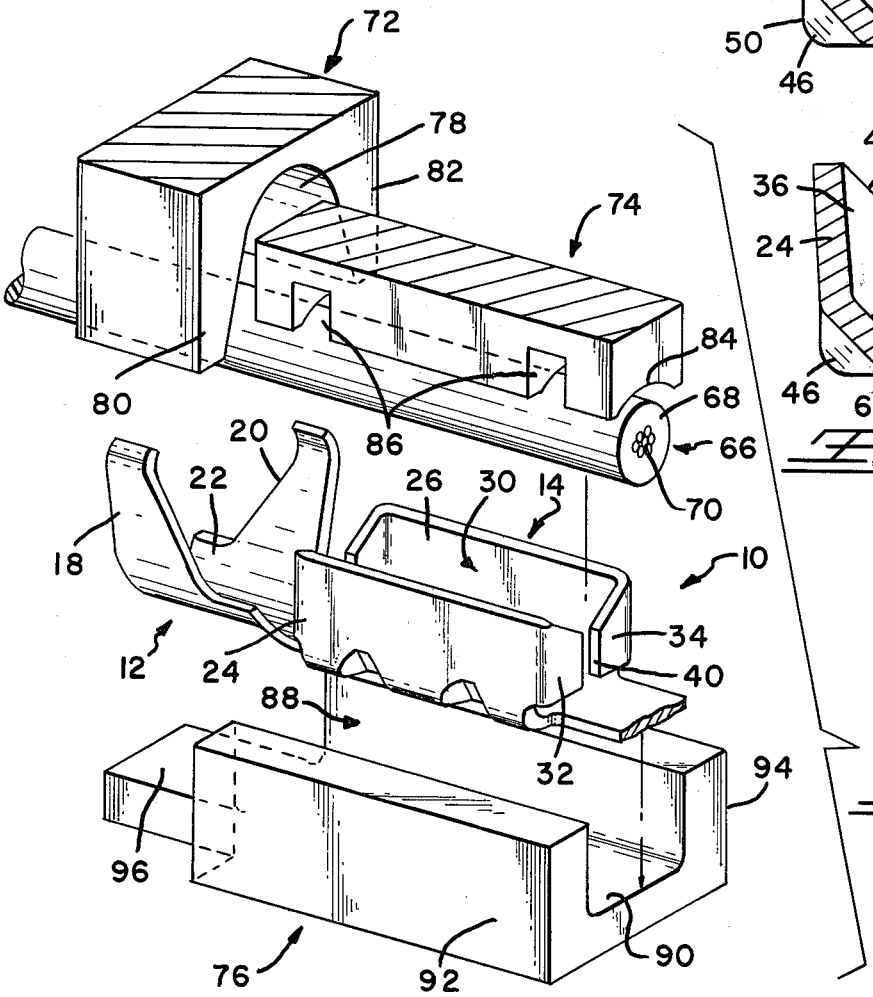
FIG. 3 is a fragmentary exploded perspective view of the terminal, a conductor, and termination tooling prior to the initiation of the termination procedure.

Referring now to FIG. 3, apparatus for terminating a conductor 66 includes a crimping block 72, an elongate bar member 74, and a crimping base 76. The crimping block 72 has an arch-shaped passageway 78 extending therethrough which is defined by the inner surfaces of two depending leg members 80, 82. The elongate bar 74 is provided with a bottom concave surface 84 adapted to cradle a length of the conductor 66. A pair of transverse notches 86 are further provided in the lower surface 84 of the bar 74 in a predetermined location, the purpose for which is described in detail below.

The elongate crimping base 76 has an elongate terminal receiving channel 88 longitudinally extending therealong; the terminal receiving channel being defined by a channel floor 90 and parallel spaced apart support walls 92, 94. Support walls 92, 94 are spaced apart a distance slightly greater than the spacing between beams 24, 26 of the subject terminal. A rearwardly extending floor extension 96 is further provided to extend rearwardly from channel floor 90.

Referring now to FIGS. 2A, 3 and 4, the termination of the conductor 66 proceeds as follows. The terminal 10 is loaded into the crimping base 76 with the side beams 24, 26 positioned inside support walls 92, 94, and the webbed base 22 of the rearward conductor supporting portion 12 resting upon extension 96 of the channel floor 90. Support walls 92, 94 of the crimping base 76, being appropriately spaced apart to permit the close entry of intermediate portion 14 therebetween, are outside and adjacent side beams 24, 26 of the terminal 10 in the loaded position.

Prior to actuation, the crimping block 72 is positioned above extension 96. Likewise, the elongate bar 74 is located above the crimping base 76 in longitudinal alignment with the conductor receiving channel 30 of the preloaded terminal 10. The conductor 66 is drawn between the legs 80, 82 of crimping block 72, and a length of the conductor is positioned beneath elongate bar 74 in a generally longitudinal alignment with the bottom surface 84 of bar 74.

The termination sequence is initiated by lowering crimping block 72 and bar 74, either independently or in unison, toward the crimping base 76. Lower concave surface 84 of the bar 74 engages and nests a length of the conductor 66, and forcibly influences this length downward into the conductor receiving channel 30 of the preloaded terminal 10. The notch portions 86 of the bar 74 are strategically located and dimensioned in lower surface 84 to receive end gate portions 32, 34, 36, 38 of the preloaded terminal therein at the bottom of the termination stroke. At this point, the bar 74 presses the length of the conductor between the side beams 24, 26 of the terminal 10 and into the conductor receiving channel 30.

As specifically shown in FIGS. 2A and 4, the insertion of a length of the conductor 66 into the channel 30 causes the length to be guided through the funnel shaped entry portions 42 and into the lower piercing slots 44 (only one of the slots 44 being shown in FIG. 2A). As the conductor 66 is forced into the lower piercing slots 44, the edge portions 40 of the end gates which define the slots serve to pierce the insulative sleeve 68 of the conductor 66 to electrically and mechanically engage inner conductive portion 70.

It should be noted that the forced entry of the conductor 66 into the slots 44 causes a force to be distributed outwardly along the end gates 32, 34, 36, 38 normal to the plane of insertion, and these outward forces tend to deflect the side beams 24, 26 outward. The rigidity of the side beams 24, 26 enhanced in the above-mentioned manner by indents 46, 48, exerts a direct counter influence through the normally projecting end gates and upon the conductor 66. This counter influence, coupled with the reinforcing support provided by the support walls 92, 94 located outside the side beams 24, 26, rigidly resists outward deflection to preserve the preset spacing between corresponding edge portions 40. The relative sharpness of these edge portions facilitate easy penetration of a potentially tough insulative sleeve 68, and thereby minimize the magnitude of insertion force required.

With reference to FIGS. 3 and 4, the insulation supporting portion 12 is made to grasp the insulative covering 68 of conductor 66 in the following manner. As crimping block 72 is lowered with the conductor 66 extending therethrough, the depending legs 80, 82 straddle the extension 96 and capture arms 18, 20 of the terminal portion 12 therebetween. The arcuate profile of arms 18, 20 serve to facilitate their capture. Further downward movement of the crimping block 72 induces arms 18, 20 to follow the curving contour of the inner surfaces defining passageway 78, and to thereby fold in grasping fashion about the insulative sleeve 68 of conductor 66. An insulation supporting crimp of this type is disclosed in U.S. Pat. No. 3,120,990 which is hereby incorporated by reference. The insulation supporting portion 12 in the crimped condition serves to protect the termination area, outlined by intermediate portion 14, from mechanical manipulations of the conductor which could adversely affect the electrical and mechanical integrity of the connection.

The terminal 10 and conductor 66 terminated thereto can then be released from the confines of the support base as shown in FIG. 5. The resilient side beams 24, 26 tend to exert a residual, spring-like force on conductor 66 to resiliently pinch the terminated conductor. This pinching effect ensures that the electrical and mechanical integrity of the connection will be maintained in an environment where changing conditions, e.g. temperature variations, tend to adversely affect contact integrity.

The principles and teachings of the subject invention are not limited in application to the above-described preferred embodiment, but can be incorporated in other alternative embodiment. One such alternative embodiment is illustrated in FIGS. 6 and 7. The terminal **10*a*** is similar to the preferred embodiment discussed above. The difference lies in the intermediate conductor engaging portion which is the only portion of the alternative embodiment that will be discussed.

The alternate intermediate conductor engaging portion 98 is shown to comprise parallel side beams 100, 102 which are spaced apart to define a conductor receiving channel 104 therebetween. Each of side beams 100, 102 has formed therefrom a single gate portion 106, 108 respectively, with each gate portion being formed intermediate the ends and side edges of its respective side beam to extend normally into the channel 104 toward a corresponding gate portion. The two opposing gate portions 106, 108 present exposed edges 110, 112, respectively, to the channel 104, and the edges 110, 112 define an entry lead in portion 114 and piercing slot 116 therebetween.

The termination tooling includes an elongate bar 118 having a notch 120 located transversely in a bottom concave surface 122 thereof. The slot is located and dimensioned to receive the gates 106, 108 therein at the bottom of the termination stroke. The termination tooling further includes a crimping block 124 and support base 126 having structure and function identical to that described above with reference to FIGS. 3 and 4.

The termination procedure follows the same sequence described in detail above, with the bar 118 moving downward to engage a conductor 128 against its bottom concave surface 122. Upon further downward movement, the bar 118 forces the conductor 128 into the conductor receiving channel 104 of the terminal **10*a* which has been preloaded in the base 126. As the conductor 128 is inserted into the channel 104, it enters the slot 116 where edges 110, 112 pierce an insulative sleeve 130 and engage a conductive portion 132 of the conductor 128. The insertion force is distributed outwardly through gates 106, 108 normal to the plane of insertion. The rigidity of the side beams 100, 102 as supported by a pair of support walls 134, 136 provided in the support base 126, prevents outward deflection of the side beams 100, 102** away from the inserted conductor. Only one gate portion need be formed from each side beam because of the perpendicular disposition of each gate portion to its respective side beam, although it will be appreciated that it is within the scope of this invention that multiple gate portions can be formed from each side beam.

The alternative terminal **10*a* and conductor 128 terminated thereto can then be released from the confines of the base 126 as shown in FIG. 7**.

The foregoing discloses representative embodiments demonstrating the principles of the instant invention, but it is not intended that application of the principles of this invention be so restricted. Other embodiments which will be apparent to one skilled in the art, and which utilize the teachings herein set forth, are intended to be included within the scope of the subject invention.

What is claimed is:

1. An electrical terminal for effecting insulation displacing termination of an electrical wire formed by a conductor covered with insulation, said terminal comprising:

a forward mating portion having a profile adapted to engage another electrical terminal;

a rearward wire engaging portion integral with said forward mating portion, said rearward wire engaging portion comprising an elongate base portion and first and second elongate beam members connected to opposite sides of said base by respective bights, said beam members being substantially parallel and spaced apart a distance slightly greater than the diameter of said wire to define a wire receiving channel therebetween, at least one indent means formed in each said beam member through said bight and into the adjacent base portion to extend into said wire receiving channel to increase the rigidity of said wire engaging portion;

each of said beam members having at least one insulation piercing extension directed into said wire receiving channel toward a corresponding insulation piercing extension of the other of said beam members, with each of said insulation piercing extensions being substantially perpendicular to its respective beam member, and each of said insulation piercing extensions having an edge portion; said edge portion of said one insulation piercing extension being spaced from said edge portion of said corresponding insulation piercing extension a distance slightly less than the diameter of said conductor, and said edge portions piercing through said insulation of said wire to establish electrical and mechanical engagement therewith as said wire is moved laterally of its axis between said beam members and into said wire receiving channel.

2. A terminal as set forth in claim 1, wherein said rearward wire engaging portion further comprises a pair of ears connected on opposite sides of said base portion by respective bights, spaced rearwardly of said beam members, and adapted to crimpingly engage said insulation thereby forming a strain relief.

3. A terminal as set forth in claim 1, wherein each said insulation piercing extension comprises an end portion of a respective beam member bent inwardly into said wire receiving channel perpendicular to said respective beam member.

4. A terminal as set forth in claim 3, wherein each said end portion has a material thickness equal the thickness of said respective beam member.

5. A terminal as set forth in claim 3, wherein said edge portion of each said insulation piercing extension comprises an edge of said end portion which is exposed to said wire receiving channel, said exposed edge of said end portion of said first beam member and said exposed edge of a corresponding said end portion of said second beam member serving to form a conductor receiving slot, said slot having an inwardly inclined entry and a constant width lower portion, said constant width lower portion being slightly less than the diameter of one of said wires.

6. A terminal as set forth in claim 1, wherein each said insulation piercing extension comprises an intermediate portion of a respective beam member bent inwardly into said wire receiving channel perpendicular to said respective beam member.

7. A terminal as set forth in claim 6, wherein each said intermediate portion has a material thickness equal the thickness of said respective beam member.

8. A terminal as set forth in claim 6 wherein said edge portion of each said insulation piercing extension comprises an edge of said intermediate portion which is exposed to said wire receiving channel, said exposed edge of said intermediate portion of one beam member and said exposed edge of a corresponding said intermediate portion of the other beam member serving to form a conductor receiving slot, said slot having a decreasing width entry upper portion and a constant width lower portion, said constant width lower portion being slightly less than the diameter of one of said wires.

9. An insulation displacement terminal for engaging electric wire having a conductive core within an insulation covering, comprising an elongate formed conductive member having a mating first end and an oppositely directed wire securing second end to which the wire is to be connected, said wire securing end having a base and first and second pairs of opposed jaws upstanding therefrom at axially spaced locations along the base, the first pair of jaws includes sidewalls upstanding from said base along axial fold lines, edges formed on flanges extending inwardly from the sidewalls, indent means formed in both the base and sidewalls extending crosswise of the axial fold lines thereby strengthening the sidewalls and increasing axial restraining of the wire relative to the terminal, said edges converging adjacent the base to be spaced apart transversely of the channel a distance slightly less than the diameter of the conductive core, the second pair of jaws having opposed tabs angled toward the base and each other, whereby when said wire with the insulation covering thereon is aligned over the exposed pairs of jaws and forced transversely therebetween and against the base, said edges of the first pair of jaws displace the insulation covering and frictionally contact the conductive core to establish an electrical and mechanical connection between the terminal and wire and also to axially restrain the wire relative to the terminal, and the second pair of jaws are crimped to overlie and trap the insulation covering against the base and transversely restrain the wire relative to the terminal.

10. An insulation displacement terminal according to claim 9, wherein flanges are formed at each end of each sidewall and have lower edges that overlie the base on opposite axial sides of said embossment means.

* * * * *

UNITED STATES PATENT OFFICE

CERTIFICATE OF CORRECTION

Patent No. 4,385,794 Dated May 31, 1983

Inventor(s) John F. Lucius et al

It is certified that error appears in the above-identified patent and that said Letters Patent are hereby corrected as shown below:

On the cover page, item (75) add co-inventor

-- Leon Thomas Ritchie , Mechanicsburg, PA --.

Signed and Sealed this

*Twelfth* Day of *June 1984*

[SEAL]

*Attest:*

GERALD J. MOSSINGHOFF

*Attesting Officer*

*Commissioner of Patents and Trademarks*

REEXAMINATION CERTIFICATE (782nd)

United States Patent [19] [11] B1 4,385,794

Lucius [45] Certificate Issued Nov. 10, 1987

[54] INSULATION DISPLACEMENT TERMINAL

[75] Inventor: John E. Lucius, Harrisburg, Pa.

[73] Assignee: AMP Incorporated, Harrisburg, Pa.

Reexamination Request:
No. 90/000,767, Apr. 26, 1985

Reexamination Certificate for:

| | |
|---|---|
| Patent No.: | **4,385,794** |
| Issued: | **May 31, 1983** |
| Appl. No.: | **351,725** |
| Filed: | **Feb. 24, 1982** |

Certificate of Correction issued May 31, 1983.

Related U.S. Application Data

[63] Continuation of Ser. No. 927,720, Jul. 25, 1978, abandoned.

[51] Int. Cl.[4] ..... H01R 4/24
[52] U.S. Cl. ..... 439/399; 439/401
[58] Field of Search ..... 339/97 R, 97 P, 98, 339/99 R, 276 SF

[56] References Cited

U.S. PATENT DOCUMENTS

| | | | |
|---|---|---|---|
| 2,433,358 | 12/1947 | Garberding | 339/215 R |
| 3,760,331 | 9/1973 | Gurley | 339/36 |
| 4,032,215 | 6/1977 | Jarmofsky | 339/258 R |
| 4,035,049 | 7/1977 | McKee | 339/97 R |

OTHER PUBLICATIONS

Department of the Navy, Ordnance Pamphlet 2230 (First Rev.) 22 Apr., 1959, *Workshop and Design Practices for Electronic Equipment*, title page, introduction and pp. 4.1 and 4.37.

*Primary Examiner*—Joseph H. McGlynn

[57] ABSTRACT

An electrical terminal is disclosed for use in the insulation displacing termination of conductors having substantially any center spacing. The terminal is provided with two spaced apart and substantially parallel side beam members which define a conductor receiving channel therebetween. Each side beam has at least one insulation piercing extension perpendicularly formed therefrom to extend into the channel toward a corresponding extension formed from the opposite side beam. As the conductor is moved laterally of its axis and into the channel, the edges of the corresponding insulation piercing extensions serve to pierce the insulative covering of the conductor and establish electrical and mechanical contact between the terminal and the conductor. Termination tooling for use in terminating the conductor is also disclosed and includes a pressing bar, and a block having supportive means for reinforcing the terminal side beams during the termination procedure.

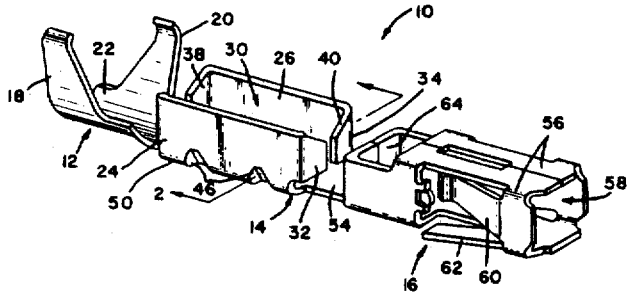

REEXAMINATION CERTIFICATE ISSUED UNDER 35 U.S.C. 307

NO AMENDMENTS HAVE BEEM MADE TO THE PATENT

AS A RESULT OF REEXAMINATION, IT HAS BEEN DETERMINED THAT:

The patentability of claims 1–10 is confirmed.

* * * * *